US006518870B2

(12) United States Patent
Yeh et al.

(10) Patent No.: US 6,518,870 B2
(45) Date of Patent: Feb. 11, 2003

(54) TRANSFORMER BOBBIN

(75) Inventors: Ming Yeh, Banchiau (TW); Heng Cheng Chou, Shinjuang (TW); Chen-Feng Wu, Bade (TW); Jen Chieh Huang, Taoyuan (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/962,165

(22) Filed: Sep. 26, 2001

(65) Prior Publication Data

US 2002/0075115 A1 Jun. 20, 2002

(30) Foreign Application Priority Data

Dec. 12, 2000 (TW) ..... 89218848 U

(51) Int. Cl.[7] ..... H01F 27/30
(52) U.S. Cl. ..... 336/198; 336/65; 336/208
(58) Field of Search ..... 336/65, 90, 192, 336/198, 208, 182, 183

(56) References Cited

U.S. PATENT DOCUMENTS 6,078,240 A * 6/2000 Huang ..... 336/90

FOREIGN PATENT DOCUMENTS

JP 3-161906 * 7/1991

* cited by examiner

*Primary Examiner*—Elvin Enad
*Assistant Examiner*—Tuyen T. Nguyen
(74) *Attorney, Agent, or Firm*—Birch, Stewart, Kolasch & Birch, LLP

(57) ABSTRACT

The transformer bobbin of the present invention includes a tubular body, a first partition wall, at least one second partition wall, at least one third partition wall and pins. The first partition wall is formed on the surface of the tubular body. The first partition wall includes a first flange having a thinner section for providing winding of a wire. The first partition wall separates a primary side from a secondary side. The second partition wall, parallel to the first partition wall, is formed on the surface of the tubular body. The second partition wall includes a second breach and a second flange having a second cut corner formed thereon. The third partition wall, interposed between the adjacent second partition walls, includes a third breach and a third flange having a third cut corner formed thereon. There is a horizontal height difference exists between the second cut corner and the third cut corner.

7 Claims, 5 Drawing Sheets

TRANSFORMER BOBBIN

BACKGROUND OF THE INVENTION

1. Field of the Invention

The present invention relates to a bobbin, and more particularly to a transformer bobbin.

2. Description of the Prior Art

A conventional transformer bobbin 10, as shown in FIG. 1(*a*) and FIG. 1(*b*), is composed of a tubular body 20 and a plurality of partition wall 30. Among these, the tubular body 20 is used to accommodate a strip of core, and providing winding of wire formed thereon. The wire includes the wire of primary side(not shown) and the wire of secondary side 60, thereafter called wire 60 for short.

Still referring to FIG. 1(*a*) or FIG. 1(*b*), the partition wall 30 is formed on the surface of the tubular body 20 so as to isolate the primary side, the secondary side and a plurality of winding grooves located on the secondary side. The partition wall 30 has a wire guiding notch 31 formed on a section of that. Besides, the partition wall 30 has a flange 33 shown in FIG. 1(*a*) or a cut corner 35 shown in FIG. 1(*b*). It should be noted that the flanges 33 and the cut corners 35 are arranged in line, on the same side and the same level. That is, there is no horizontal height difference between the flanges 33 and the cut corners 35.

Still referring to FIG. 1(*a*) or FIG. 1(*b*), the secondary side of the tubular body 20 further has 2 pins, including a start terminal 50*a* and an ending terminal 50*b*. Among these, the start terminal 50*a* is used as a terminal from which winding of wire 60 is started and the ending terminal 50*b* is used as a terminal at which winding of wire 60 is terminated. During the wire 60 extends from the start terminal 50*a* to the ending terminal 50*b*, the wire 60 passes the winding groove so as to form windings. Once the winding number of a winding groove conforms to a predetermined value, the wire 60 extends to the next adjacent winding groove to form another winding. In this manner, selectiveness of voltage is formed. For the simplification of drawing, the present invention merely depicts the wire 60 adjacent to the start terminal 50*a* and the ending terminal 50*b*.

Still referring to FIG. 1(*a*) or FIG. 1(*b*), during the winding is accomplished and the wire 60 goes back to the ending terminal 50*b*, it is dangerous if the wire 60 lacks of support and fix since the terminal of the wire 60 is on the opposite of the secondary side and thus far from the ending terminal 50*b*. The wire 60 is liable to be cut off.

The wire 60 closes to the outer portion having the highest voltage of the winding and short circuit, resulted from undesired displacement, thus is liable to occur even though the wire 60 is still continuous.

Prior art proposed for solving the above problem includes a step of twisting the wire 60 after which extends from the opposite of the secondary side to the ending terminal 50*b*. The step of twisting is used to strengthen the wire 60 and may solve the problem. However, the step is additional and fails to fix the wire 60.

Alternatively, the above-mentioned flange 33 or the cut corner 35 is provided to support and fix the wire 60. However, the bobbin having the cut corners 35 fails to provide the wire 60 with overall support and any fix. For example, the cut corner 35 can prevent the displacement of the wire 60 caused by the external force form the right side of drawing but fails to prevent the displacement of the wire 60 caused by the external force form the left side of drawing. On the other hand, the bobbin having the flange 33 merely supports the wire 60 but fails to provide fix.

Accordingly, there has been a strongly felt need for a novel bobbin providing the wire with support and fix to solve the above-mentioned problem. Besides, it is desired that the manufacturing process of the transformer using the bobbin is simplified.

SUMMARY OF THE INVENTION

The main object of the present invention is to overcome the aforementioned problems. Besides, the present invention omits one manufacturing step compared to prior art.

The present invention includes a tubular body, a first partition wall, at least one second partition wall, at least one third partition wall, a plurality of pins of primary side and two pins of secondary side. The first partition wall is formed on the surface of the tubular body so as to separate the primary side from the secondary side. Additionally, the first partition wall has a first flange having a thinner section used to provide winding of the wire. The second partition walls parallel to the first partition wall are also formed on the surface of the secondary side of the tubular body. Each of the second partition walls has a second breach and a second flange having a second cut corner formed thereon. Each of the third partition walls is interposed between the adjacent second partition walls. The third partition walls has a third breach and a third cut corner formed thereon. The second cut corner and the third cut corner are on the same side but not on the same level.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1(*b*) is another conventional transformer bobbin;

FIG. 3(*b*) is second embodiment of winding according to the present invention.

DESCRIPTION OF THE PREFERRED EMBODIMENT

Figure 1A:
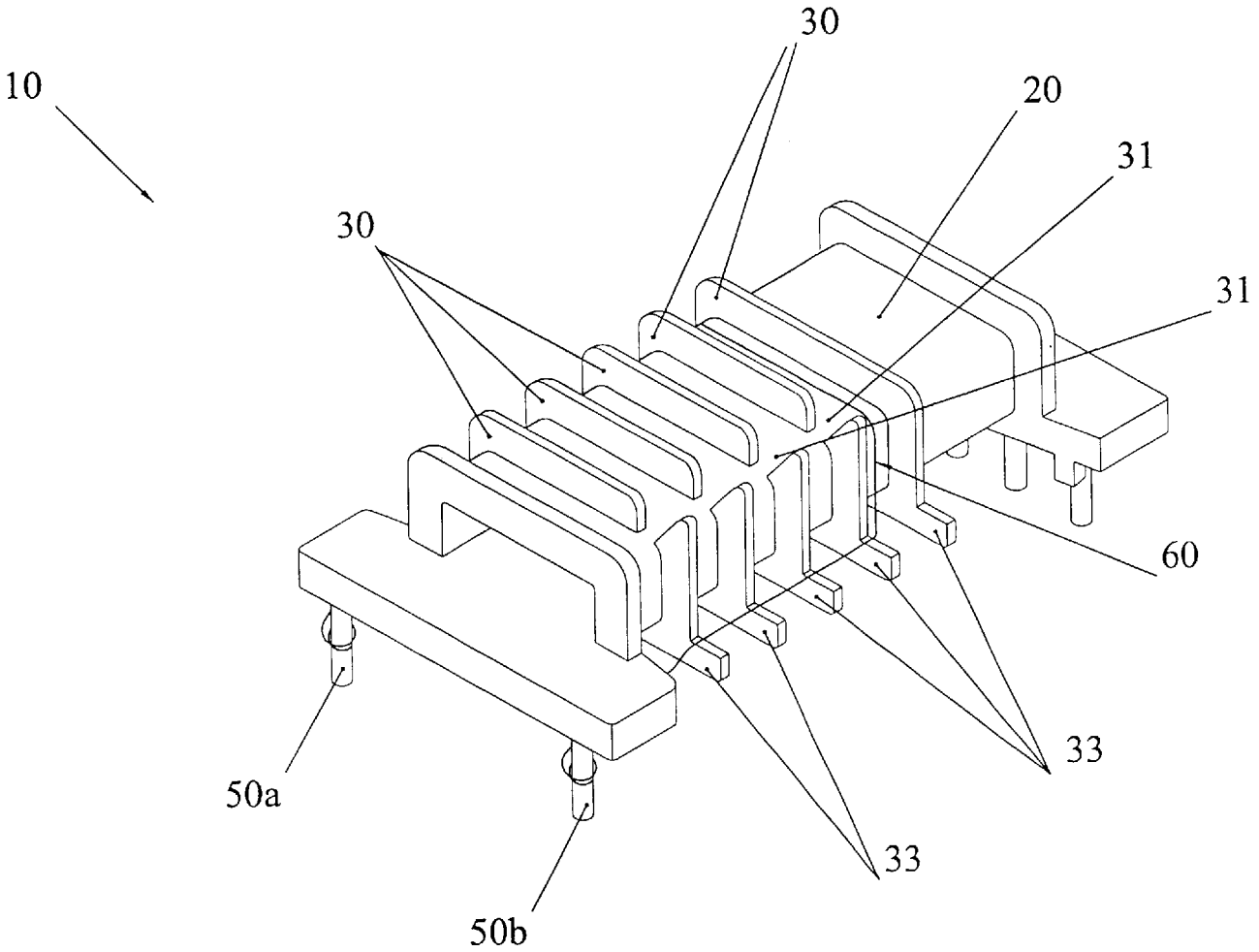
FIG. 1a ( PRIOR ART )
FIG. 1(*a*) is a conventional transformer bobbin.
Figure 1B:
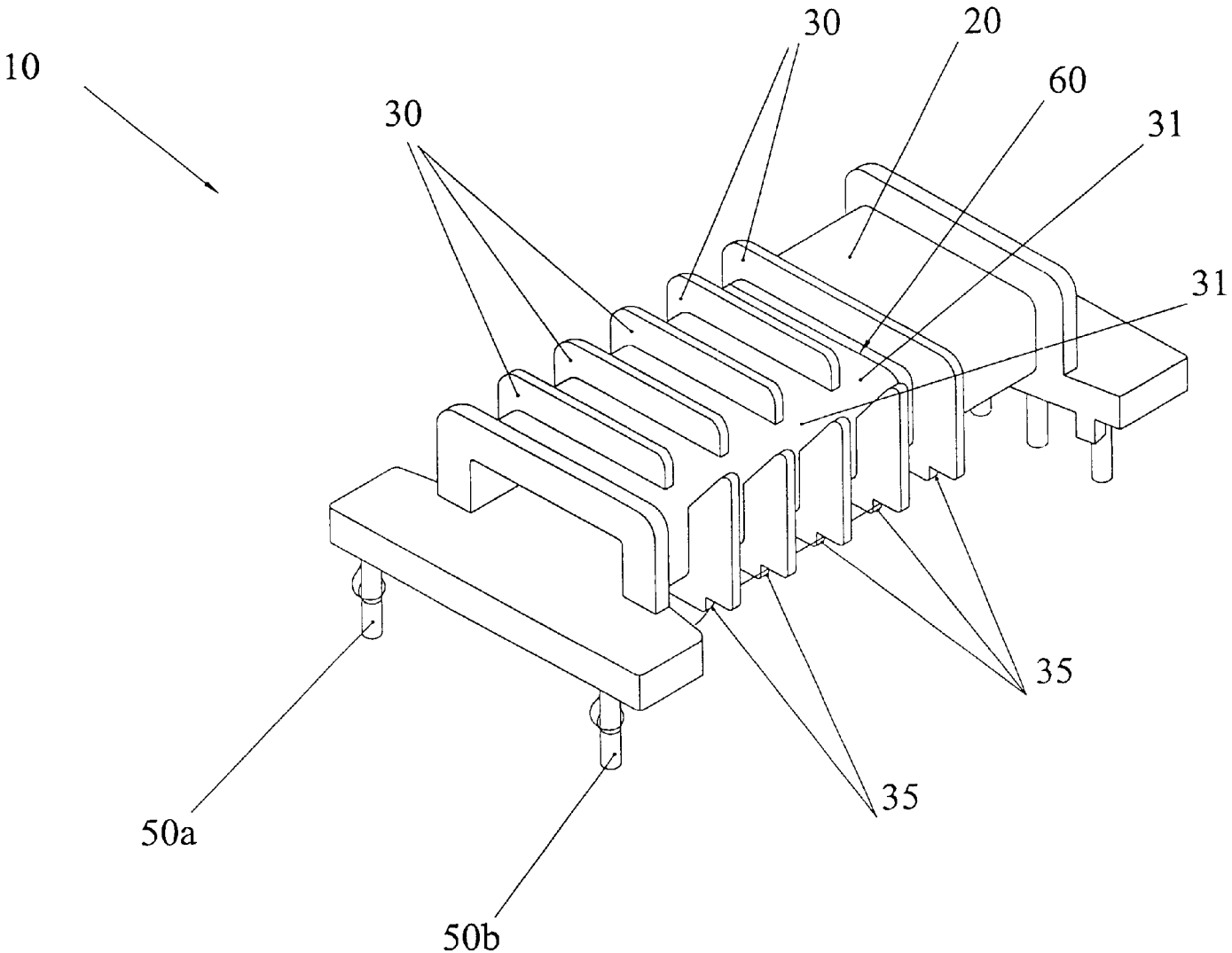
FIG. 1b ( PRIOR ART )
Figure 2:
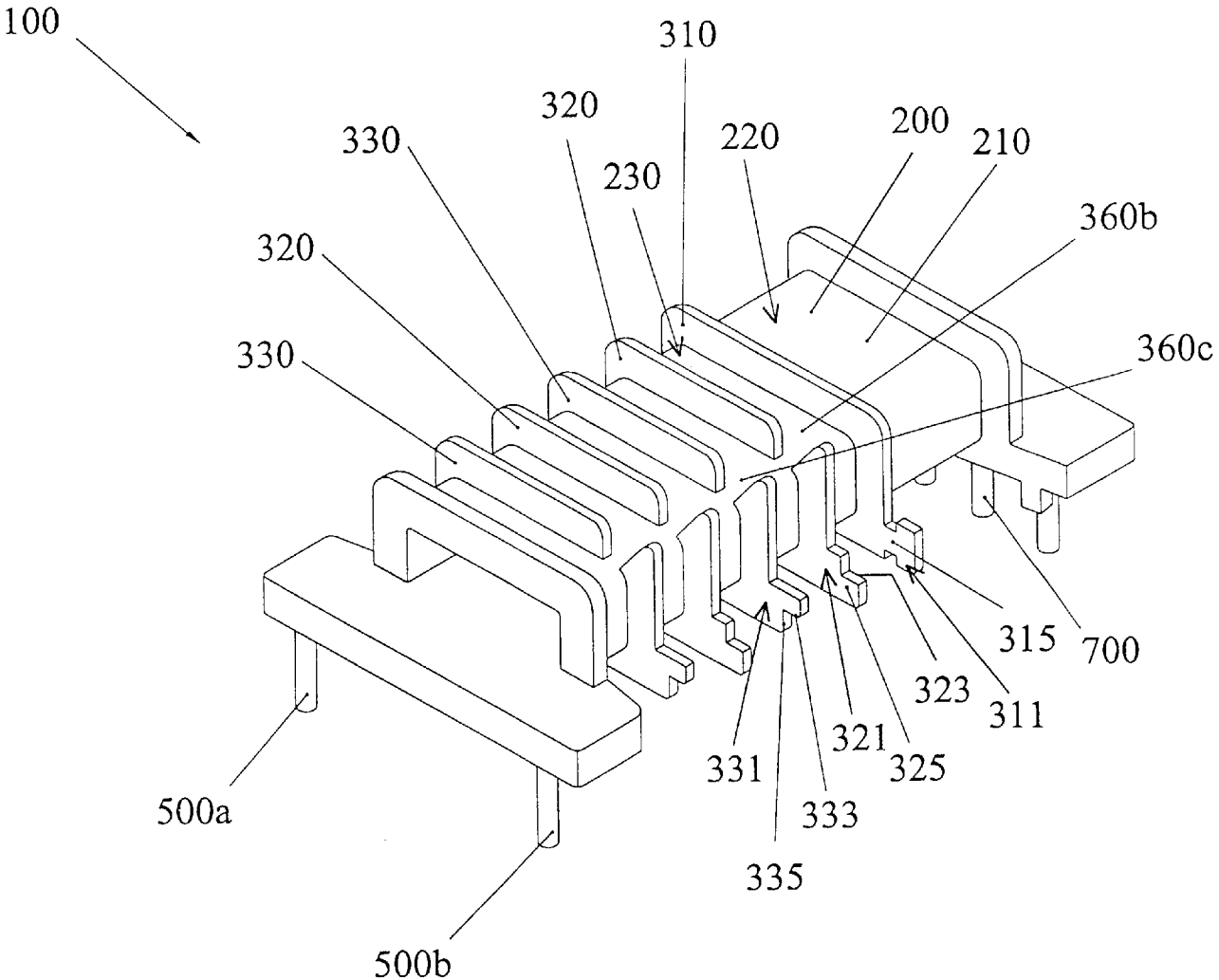
FIG. 2 is the transformer bobbin according to the present invention.

Referring to FIG. 2, the present invention comprises a tubular body 200, a first partition wall 310, a plurality of second partition walls 320, a plurality of third partition walls 330, a plurality of first pins 700, and two second pins 500*a*, 500*b*. Among these, the tubular body 200 provided with a surface 210 is used to accommodate a strip of core (not shown), and provide winding of wire formed thereon so as to form a transformer. The first partition wall 310 is formed on the surface 210 of the tubular body 200 so as to divide the body 200 into a primary side 220 and a secondary side 230. The wire includes a wire (not shown) disposed on the primary side 220, and a wire 600 disposed on the secondary side 230, thereafter called wire 600 for short. Additionally, the first partition wall 310 has a first flange 311. The first flange 311 is provided with a neck portion 315 that is narrower than the other portion of the first flange 311. The neck portion 315 is used to provide winding of the wire 600. Specifically, winding of the wire 600 is wound on the neck portion 315 during the winding.

Still referring to FIG. 2, the second partition walls 320 parallel to the first partition wall 310 are also formed on the surface 210 of the secondary side 230 of the tubular body 200. Each of the second partition walls 320 has a first breach 360*b* and a second flange 321. The second flange 321 is provided with a first notch 325 so as to form a first surface 323. Each of the third partition walls 330 is interposed between the adjacent second partition walls 320 such that a plurality of winding grooves are formed on the secondary side 230 of the tubular body 200. That is, along the direction from the primary side 220 extending to the secondary side 230, the first partition walls 310 is followed by the second partition walls 320; and the second partition walls 320 is followed by the third partition walls 330. Each of the third partition walls 330 has a second breach 360*c* and a third flange 331. The third flange 331 is provided with a second notch 335 so as to form a second surface 333. The first breach 360*b* and the second breach 360*c* are arranged in line. It should be noted that the first notch 325 and second notch 335 are on the same side, but the first surface 323 and the second surface 333 are not on the same level. That is, there is horizontal height difference existing between the first surface 323 and the second surface 333. Specifically, the first surface 323 of the second flange 321 is higher than the second surface 333 of the third flange 331. The first pins 700 are disposed on the primary side 220 of the body 200. The second pins 500*a,* 500*b* are disposed on the secondary side 230 of the body 200.

The First Embodiment of Winding

Figure 3A:
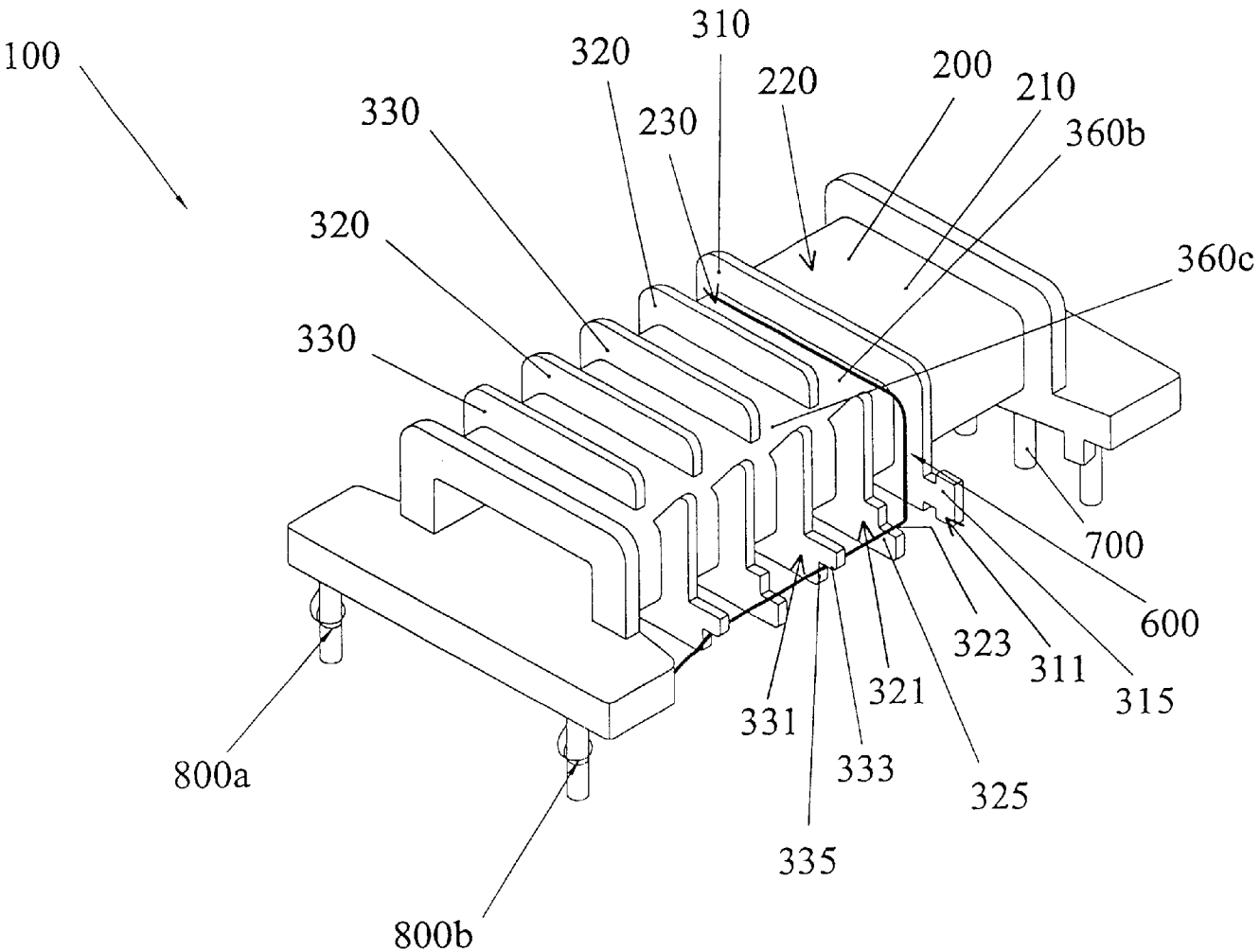
FIG. 3(*a*) is first embodiment of winding according to the present invention.
Figure 3B:
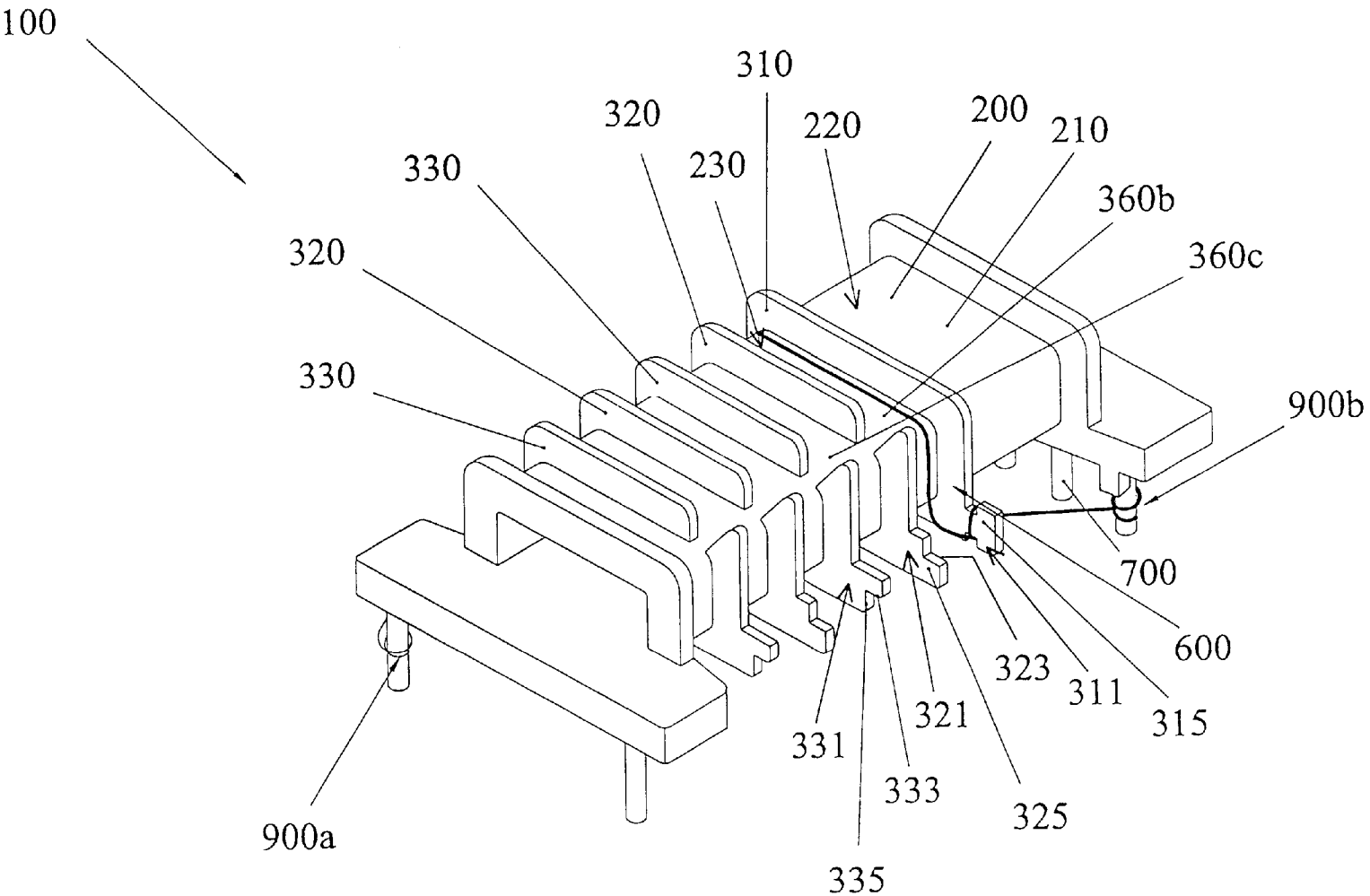

Referring to FIG. 3(*a*), one of the second pins 500*a* functions as a start terminal 800*a,* and the other second pin 500*b* functions as an ending terminal 800*b*. In the first embodiment, the start terminal 800*a* and the ending terminal 800*b* are respectively disposed on the secondary side 230 of the body 200 so as to fit with the layout of the PCB where the transformer using the bobbin mounted thereon. Among these, the start terminal 800*a* functions as a terminal from which winding of wire 600 is started and the ending terminal 800*b* functions as a terminal at which winding of wire 600 is terminated. During the wire 600 extends from the start terminal 800*a* to the ending terminal 800*b,* the wire 600 passes the winding groove so as to form windings. Once the winding number of a winding groove conforms to a predetermined value, the wire 600 extends to the next adjacent winding groove through the first breach 360*b* or the second breach 360*c* to form another winding. In this manner, selectiveness of voltage is formed. For the simplification of drawing, the drawing of the present invention omits the wire formed on the winding groove and thus merely depicts the wire 600 adjacent to the start terminal 800*a* and the ending terminal 800*b*.

Still referring to FIG. 3(*a*), during the winding is accomplished and the wire 600 goes back to the ending terminal 800*b,* the wire 600 passes over the first notch 325; pass under the second notch 335 and then ultimately fastened to the ending terminal 800*b*. In this manner, the horizontal height difference existing between the first notch 325 and second notch 335 provides the wire 600 with excellent support and fix. Thus, since the first surface 323 of the second flange 321 is higher than the second surface 333 of the third flange 331, the wire 600 can be fixed and supported on the bobbin 100 in a plumb direction.

The Second Embodiment of Winding

Referring to FIG. 3(*b*), one of the second pins 500*a* functions as a start terminal 900*a,* and one of the first pins 700 functions as an ending terminal 900*b*. In the second embodiment, the start terminal 900*a* is disposed on the secondary side 230 of the body and the ending terminal 900*b* is disposed on the primary side 220 of the body 200 so as to fit with the layout of the PCB where the transformer using the bobbin mounted thereon. Among these, the start terminal 900*a* functions as a terminal from which winding of wire 600 is started and the ending terminal 900*b* functions as a terminal at which winding of wire 600 is terminated. During the wire 600 extends from the start terminal 900*a* to the ending terminal 900*b,* the wire 600 passes the winding groove so as to form windings. Once the winding number of a winding groove conforms to a predetermined value, the wire 600 extends to the next adjacent winding groove through the first breach 360*b* or the second breach 360*c* to form another winding. In this manner, selectiveness of voltage is formed. For the simplification of drawing, the drawing of the present invention omits the wire formed on the winding groove and thus merely depicts the wire 600 adjacent to the start terminal 900*a* and the ending terminal 900*b*.

Still referring to FIG. 3(*b*), during the winding is accomplished and the wire 600 extends to the ending terminal 900*b,* winding of the wire 600 wound on the neck portion 315 is thus formed and then the wire 600 is ultimately fastened to the ending terminal 900*b*. In this manner, the neck portion 315 provides the wire 600 with excellent support and fix.

Referring to FIG. 3(*a*) or FIG. 3(*b*), the present invention provides the wire with an overall fixing and support. Since the wire 600 wound on the neck portion 315 obtains an excellent support, the present bobbin can resist the horizontal external force. In addition, since the first surface 323 of the second flange 321 is higher than the second surface 333 of the third flange 331, the wire 600 can be fixed and supported on the bobbin 100 in a plumb direction. The present bobbin further resists the vertical external force by means of the second partition walls 320 or the third partition walls 330. In this manner, the wire is not liable to be cut off. Besides, since the present invention provides the wire with an excellent fixing and support, twisting wire is not required. That is, the present invention omits one manufacturing step compared to prior art.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A transformer bobbin, comprising:

a tubular body including a surface;

a first partition wall formed on the surface of said tubular body, wherein said first partition wall includes a first flange having a neck portion for a wire to be wound around, and divides the body into a primary side and a secondary side;

at least one second partition wall, parallel to said first partition wall, formed on the surface of said tubular body, wherein said at least one second partition wall includes a first breach and a second flange, and the second flange includes a first notch to form a first surface that towards upwards;

at least one third partition wall interposed between said adjacent second partition walls, wherein said third partition wall includes a second breach and a third flange, the third flange includes a second notch to form a second surface, and a horizontal height difference exists between said first surface and said second surface that towards downwards;

a plurality of first pins disposed on the primary side; and two second pins disposed on the secondary side.

2. The transformer bobbin according to claim 1, further comprising a wire wound on said secondary side.

3. The transformer bobbin according to claim 1, wherein one of the second pins is used as a start terminal, and the other second pin is used as an ending terminal.

4. The transformer bobbin according to claim 1, wherein one of the second pins is used as a start terminal, and one of the first pins is used as an ending terminal.

5. The transformer bobbin according to claim 1, wherein said second breach and said third breach are on the same side and arranged in line.

6. The transformer bobbin according to claim 1, wherein said tubular body is used to accommodate a strip of core.

7. The transformer bobbin according to claim 1, wherein said second partition wall and said third partition wall are used to form a plurality of winding grooves.

* * * * *